US005216775A

United States Patent [19]

Takasaki

[11] Patent Number: 5,216,775

[45] Date of Patent: Jun. 8, 1993

[54] AUTOMATIC SQUEEZEE PRESSING DEVICE

[75] Inventor: Tadao Takasaki, Tokyo, Japan

[73] Assignee: Nihon Bisoh Co., Ltd., Tokyo, Japan

[21] Appl. No.: 664,484

[22] Filed: Mar. 4, 1991

Related U.S. Application Data

[63] Continuation of Ser. No. 422,910, Oct. 17, 1989, abandoned.

[30] Foreign Application Priority Data

Oct. 20, 1988 [JP] Japan ..... 63-137285[U]

[51] Int. Cl.[5] ..... A47L 1/00

[52] U.S. Cl. ..... 15/103; 15/250.11; 15/302

[58] Field of Search ..... 15/103, 302, 50.1, 50.2, 15/50.3, 250.20, 250.11

[56] References Cited

U.S. PATENT DOCUMENTS 4,198,724 4/1980 Fisher et al. ..... 15/103
4,718,139 1/1988 Okuda et al. ..... 15/250.20
4,736,484 4/1988 Bauer et al. ..... 15/250.20
4,777,695 10/1988 Okuda et al. ..... 15/250.20
4,785,491 11/1988 Yamamoto ..... 15/250.2
4,800,607 1/1989 Fukutomi ..... 15/302
4,809,384 3/1989 Yokota et al. ..... 15/103

FOREIGN PATENT DOCUMENTS 0283849 9/1988 Fed. Rep. of Germany ..... 15/250.2

*Primary Examiner*—Harvey C. Hornsby
*Assistant Examiner*—Patrick F. Brinson
*Attorney, Agent, or Firm*—Hedman, Gibson & Costigan

[57] ABSTRACT

An automatic squeezee pressing device for pressing a squeezee against a window pane with a constant pressing force comprises a squeezee to be pressed against a window pane for cleaning the window pane, a squeezee moving mechanism for moving the squeezee toward or away from the window pane, a sensor provided in association with the squeezee for detecting pressing force of the squeezee pressed against the window pane and producing a detection output, and a control circuit responsive to the detection output of the sensor for supplying a control signal to the squeezee moving mechanism so as to maintain the pressing force of the squeezee constant.

3 Claims, 4 Drawing Sheets

AUTOMATIC SQUEEZEE PRESSING DEVICE

This application is a continuation of Ser. No. 07/422,910, filed Oct. 17, 1989, now abandoned.

BACKGROUND OF THE INVENTION

This invention relates to an automatic squeezee pressing device for pressing squeezees used for cleaning window panes against a window pane with a constant pressing force so that window panes can be cleaned without leaving an uncleaned portion notwithstanding an error in mounting window panes to a building or existence of a curved portion in a window pane.

As high-storied buildings increase, the number of windows formed in these buildings also increases. For maintaining window panes of these windows clean, a regular window pane cleaning work becomes necessary.

A conventional window pane cleaning work is carried out manually by an operator who splashes water over a window pane from a moving scaffold hung from a roof of a building, wipes dust off the window pane by a squeezee and collects dust with soiled water. Such manual cleaning work is inefficient and besides is dangerous.

A device has been developed to automate the window pane cleaning work. According to this prior art device, as shown in FIG. 3, a pair of vertically arranged squeezees 2 and 3 are mounted on a cleaning unit 1 which is hung from a roof of a building and is adapted to move up and down and a spray nozzle 4 is provided between these squeezees 2 and 3. Water is sprayed over a window pane W by the spray nozzle 4 while the cleaning unit 1 is moved down and dust is removed by the upper squeezee 2 and collected into a soiled water tank (not shown) by the lower squeezee 3.

For performing a satisfactory cleaning work by this prior art window pane cleaning device, it is necessary to keep pressing at least the upper squeezee 2 among the pair of squeezees 2 and 3 to the surface of the window pane W with a constant force. For this purpose the, length of projection of the squeezees 2 and 3 from the cleaning unit 1 is adjusted, before starting of the cleaning work, by changing positions at which these squeezees 2 and 3 are fixed to the cleaning unit 1.

The interval between the surface of the window pane W and the cleaning unit 1, however, is not constant because there are variations, occurring due to an error in the mounting work, in a position at which guide members are mounted along the window for guiding the cleaning unit 1 in moving up and down along the window and also in a position at which the window pane is mounted in the window. Pressing force of the squeezees 2 and 3 therefore varies due to such variation in the interval between the surface of the window pane W and the cleaning unit 1.

For this reason, the position of the upper squeezee 2 with respect to the window pane W tends to shift from an optimum position shown in FIG. 4*a* to a position shown in FIG. 4*b* which is too spaced away from the window pane W or to a position shown in FIG. 4*c* which is too close to the window pane W. This causes the problem that an unwiped portion is left on the window pane W after the cleaning work (in the case of FIG. 4*b*) or that resistance to the squeezees increases or scars are produced on the window pane W (in the case of FIG. 4*c*).

In some buildings in which window panes W continue in the horizontal direction, the cleaning work must be performed by moving the cleaning unit 1 horizontally. In this case also, there occurs an error in mounting of window panes and, besides, a curved window pane is sometimes employed at a corner of the building. The interval between the squeezee 2 and the surface of the window pane W must vary at the corner portion of the window pane W as shown in FIG. 4*d* with a result that an unwiped portion is left on the curved window pane W or, conversely, resistance to the squeezee 2 increases.

It is, therefore, an object of the invention to provide an automatic squeezee pressing device capable of pressing squeezees with an optimum constant force over the entire width of a window pane and thereby achieving an excellent window pane cleaning work.

SUMMARY OF THE INVENTION

An automatic squeezee pressing device achieving the above described object of the invention comprises a squeezee to be pressed against a window pane for cleaning the window pane, squeezee moving means for moving the squeezee toward or away from the window pane, a sensor provided in association with the squeezee for detecting a pressing force of the squeezee pressed against the window pane and producing a detection output, and control means responsive to the detection output of the sensor for supplying a control signal to the squeezee moving means so as to maintain the pressing force of the squeezee constant.

According to the automatic squeezee pressing device of the invention, the squeezee is provided on a unit which is hung from a roof of a building via, for example, a roof car adapted to move along the edge of the roof of the building, and which is adapted to move vertically or horizontally along the outer wall of the building. The squeezee moving means moves the squeezee toward or away from the window pane through a mechanism such as a feed screw device. The sensor provided in association with the squeezee detects the pressing force of the squeezee against the window pane and supplies a detection signal to the control device. In response to the detection signal, the control device controls the squeezee moving device so that, when the detected pressing force of the squeezee is larger than a reference value, the squeezee moving means moves the squeezee away from the window pane whereas, when the detected pressing force is smaller than a reference value, the squeezee moving means moves the squeezee toward the window pane.

According to the invention, a satisfactory window pane cleaning work can be achieved without leaving an unwiped portion on a window pane after the cleaning work or causing undesirable increase in resistance to the squeezee during the cleaning work.

A preferred embodiment of the invention will now be described with reference to the accompanying drawings.

BRIEF DESCRIPTION OF THE DRAWINGS

In the accompanying drawings.

Figure 3:
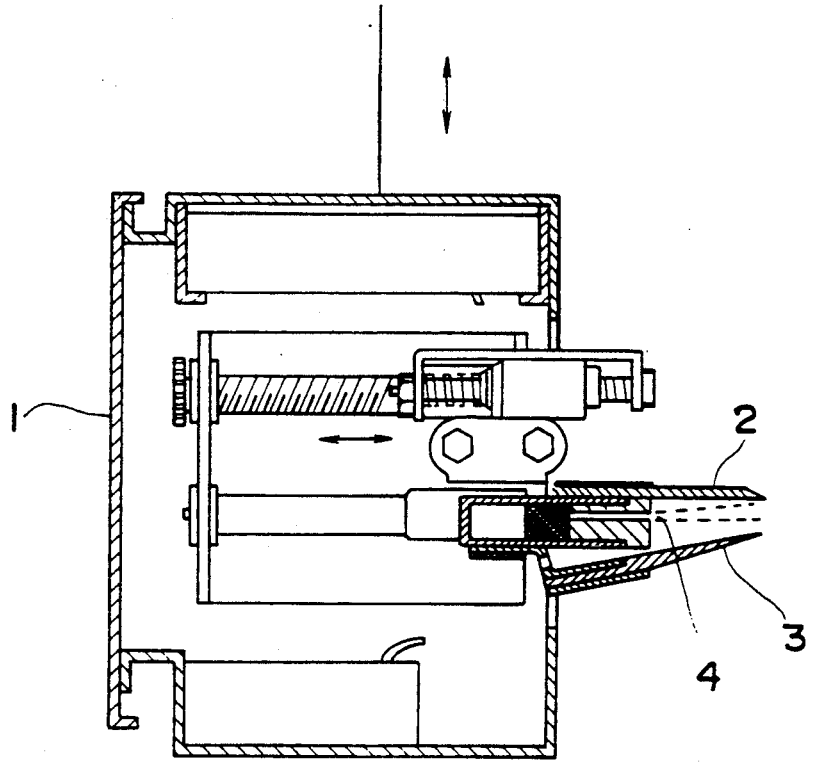
Figure 4A:
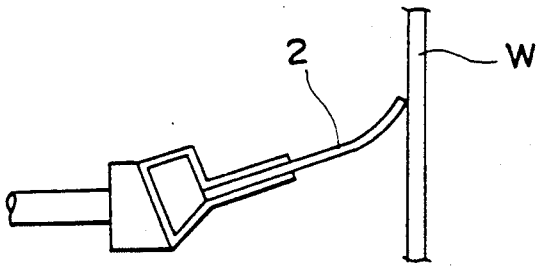
Figure 4B:
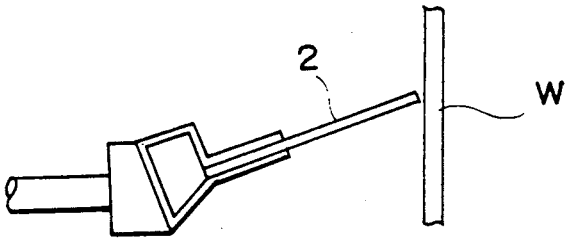
Figure 4C:
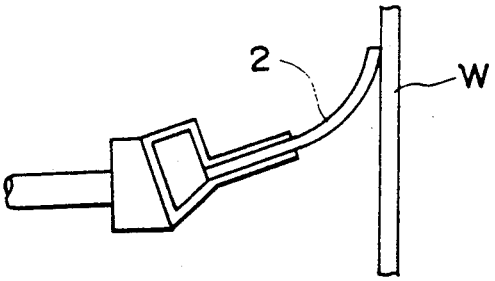
Figure 4D:
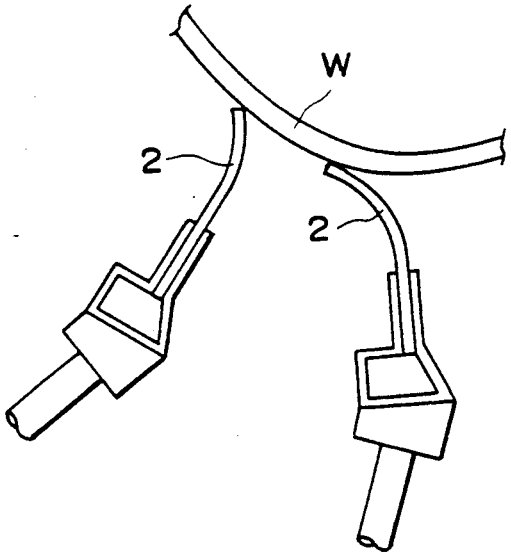

FIGS. (2A-B) is a front view showing a state of mounting of the squeezees on a unit of the device;

FIG. 3 is a cross sectional view of a prior art squeezee pressing device; and

FIGS. 4*a* to 4*d* are views showing variations in the position of the squeezees.

DESCRIPTION OF A PREFERRED EMBODIMENT

Figure 1:
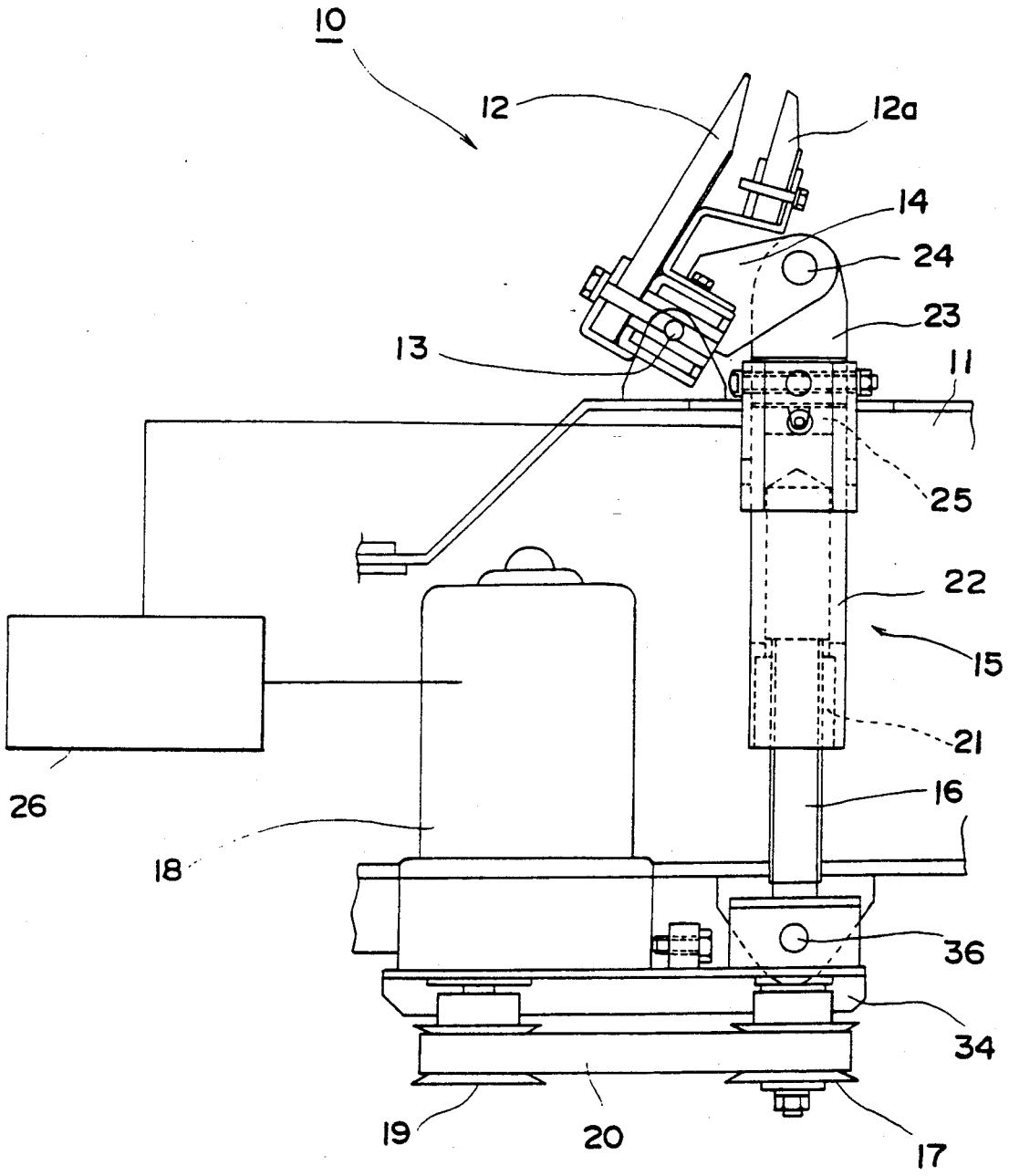
FIG. 1 is a cross sectional view of a portion including a pair of squeezees of a preferred embodiment of the automatic squeezee pressing device according to the invention.
Figures 2A, 2B:
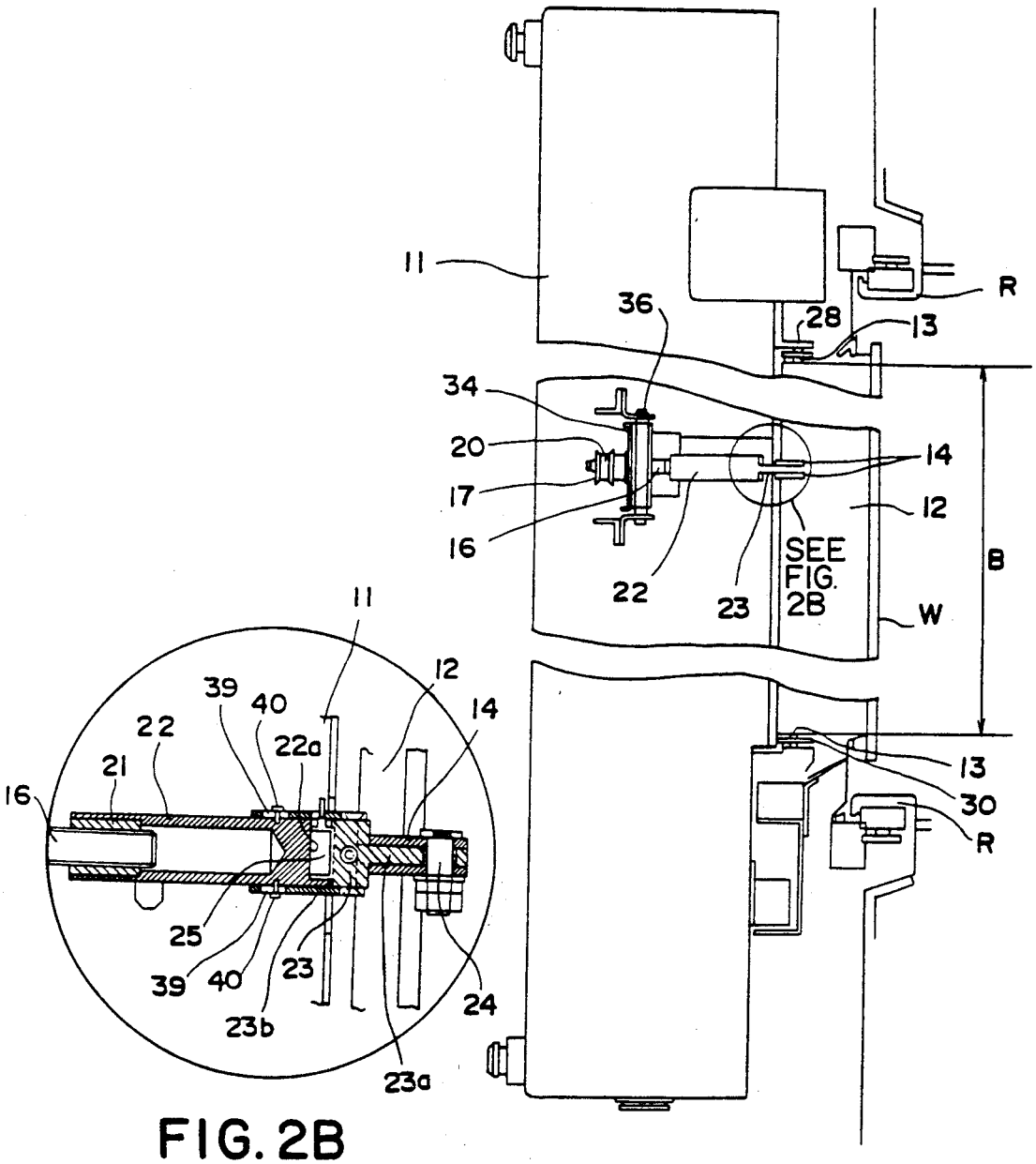

Referring to FIGS. 1 and 2, an embodiment of the invention will be described.

An automatic squeezee pressing device 10 is mounted on a cleaning unit 11 which is movable to a desired location on an outer wall surface of a building on which a window pane W is provided. In a window pane cleaning apparatus as shown in FIGS. 1 to 3 which is of a type adapted to wipe the window pane W in a horizontal direction, the unit 11 is made in the form of a box adapted to slide in the horizontal direction along upper and lower rails R extending along the upper and lower edges of the window panes W which are provided continuously in the horizontal direction. In an unillustrated window pane cleaning apparatus which is of a type adapted to wipe the window pane W in a vertical direction, the unit 11 may be made in the form of a box which is oblong in the horizontal direction and is moved up and down by means of a couple of wires hung from a roof car which moves on the roof of the building.

This unit 11 is formed in the front surface thereof facing the window pane W with an opening of a length equivalent to width B of the window pane W to be cleaned. The automatic squeezee pressing device 10 is provided in this opening of the unit 11 as one of cleaning devices provided in the cleaning unit 11.

In this automatic squeezee pressing device 10, as shown in FIG. 2, upper and lower projections 28 and 30 are provided adjacent the upper and lower edges of the opening of the unit 11 and a squeezee support shaft 13 is rotatably supported at its upper and lower end portions between these projections 28 and 30. As shown in FIG. 1, a pair of squeezees 12 and 12*a* are fixedly secured to this squeezee support shaft 13 by means of bolts 33.

A bifurcated arm 14 is secured fixedly to the squeezee support shaft 13 at the middle portion thereof. By rotating the squeezee support shaft 13 through the arm 14, the squeezees 12 and 12*a* can be moved toward and away from the window pane W.

A squeezee moving mechanism 15 includes, as shown in FIG. 1, a feed screw 16 provided in the unit 11, a pulley 17 mounted at the outer end portion thereof, a motor 18, a pulley 19 provided on the motor shaft of the motor 18, a belt 20 provided between the pulleys 17 and 19, a moving shaft 22 having a female screw portion 21 and being in threaded engagement with the feed screw 16 inserted therein and a connecting block 23 provided adjacent the inner end portion of the moving shaft 22 with some clearance therebetween. The moving shaft 22 is adapted to move in reciprocating motion without rotation by rotation of the feed screw 16. The connecting block 23 consists of a tongue member 23*a* and a box-like member 23*b* with open ends connected to the tongue member 23*a* by means of bolts 32. The moving shaft 22 is slidably inserted in the box-like member 23*b*. The arm 14 for the squeezees 12 and 12*a* is pivotably connected to the tongue member 23*a* of the connecting block 23 by means of a pivot pin 24.

A pressure sensor 25 is provided in a recess 22*a* formed in the inner end portion of the moving shaft 22. When the moving shaft 22 is caused to reciprocate, the connecting block 23 is moved through the pressure sensor 25 whereby the squeezees 12 and 12*a* are rotated about the squeezee support shaft 13 to move toward or away from the window pane W.

By reciprocating the moving shaft 22 by the feed screw 16 and thereby rotating the arm 14 through the connecting block 23, the pin 24 connecting the arm 14 with the connecting block 23 displaces along an arc formed about the support pin 13. For allowing this arcuate displacement of the pin 24, a table 34 on which the feed screw 16, pulley 17, motor 18, pulley 19 and belt 20 are mounted is pivotable about a pin 36.

There is provided some clearance between the moving shaft 22 and the connecting block 23. Owing to this clearance, power transmission is made through the pressure sensor 25 in both cases of forward and backward moving of the moving shaft 22 and detection of pressure is achieved. The box-like member 23*b* of the connecting block 23 is formed with slots 39 and the moving shaft 22 is connected to the connecting block 23 by means of bolts 40 inserted in the slots 39.

A detection signal of the pressure sensor 25 is applied to the control device 26 and a control signal from the control device 26 is supplied to the motor 18 for performing a feedback control.

In the unit 11 are also provided, in addition to the above described squeezees 12 and 12*a*, other devices including a cleaning unit and soiled water recovery tank necessary for the window pane cleaning operation.

In the automatic squeezee pressing device 10 of the above described construction, pressure for pressing the squeezees 12 and 12*a* against the window pane W is preset and cleaning of the window pane W is performed while the unit 11 is moving.

When the squeezees 12 and 12*a* are away from an optimum position against the window pane W and the pressing force therefore is smaller than the preset pressure, the value detected by the pressure sensor 25 also is smaller than a reference value and the control device 26 produces a signal to the motor 18 so as to increase the pressure.

The feed screw 16 thereupon is rotated to move the moving shaft 22 toward the window pane W. The arm 14 thereby is rotated counterclockwise to press the squeezees 12 and 12*a* toward the window pane W until the preset pressure is achieved.

When, conversely, pressing force for pressing the squeezees 12 and 12*a* against the window pane W is larger than the preset value, a detected value from the pressure sensor 25 also is larger than the reference value. In this case, the control device 26 produces a signal for moving the moving shaft 22 away from the window pane W. The arm 14 is thereby rotated clockwise to move the squeezees 12 and 12*a* away from the window pane W until the preset pressure is acheived.

While the pressing force of the squeezees 12 and 12*a* is being adjusted, reaction force from the window pane W acts on the squeezees 12 and 12*a* and power is not transmitted through the bolts 40 connecting the moving shaft 22 and the connecting block 23 but is transmitted through the pressure sensor 25.

By cleaning the window pane W while pressing the squeezees 12 and 12*a* with an optimum pressing force, an unwiped portion on the window pane W is eliminated and cleaning is made without increasing resistance of the squeezees 12 and 12*a*.

Even if there is a curved portion in the window pane W, cleaning can be achieved with the squeezees 12 and 12*a* being constantly held at an optimum position.

The automatic squeezee pressing device 10 is not necessarily provided only one in the vertical direction of the squeezees 12 and 12*a* but a plurality of such devices 10 may be provided vertically so as to ensure a constant pressing force in case the window pane W is inclined. In this case, the squeezee support shaft 13 may be flexed or end portions of the squeezee support shaft 13 may be displaced.

Instead of wiping the cleaning width B with a single pair of squeezees, the squeezees may be divided in the direction of its width and the cleaning work may be effected by staggering the respective pairs of squeezees from each other. This arrangement will enable shortening and inclination of each squeezee.

The squeezee moving mechanism 15 is not limited to the above described type in which a feed screw is employed but may be of another type such as a rotary type mechanism using gear wheels and a cam or a reciprocating type mechanism using a hydraulic cylinder.

The direction of wiping by the squeezees 12 and 12*a* is not limited to a horizontal direction but may be a vertical direction as has been adopted in the past.

Any suitable type of pressure sensor may be employed as the pressure sensor 25 and the position at which the pressure sensor 25 is mounted is not limited to the position shown in the figures but may be any other position so long as pressing force of the squeezees can be detected. Further, other devices necessary for the cleaning work may be selected as desired.

What is claimed is:

1. An automatic squeezee pressing device in a window pane cleaning device for cleaning window pane of a building comprising:

a squeezee, a squeezee moving means for rotating said squeezee toward and away from the window pane comprising a feed screw, a motor, means for transmitting the rotation of the motor to the feed screw, a moving shaft having a female screw portion and being in threaded engagement with the feed screw inserted therein, a connecting block provided at the inner end portion of the moving shaft, squeezee support means for pivotably supporting the squeezee, and arm means fixedly secured to the squeezee support means at one end thereof and pivotably connected at the other end thereof to the connecting block;

sensor means provided in association with the squeezee for detecting the pressing force of the squeezee against the window pane continuously during window pane cleaning work and including means for producing a pressing force detection output signal; and control means responsive to the pressing force detection output signal of the sensor means at any time during the window pane cleaning work for supplying a control signal to the squeezee moving means in such a manner that when the value of the pressing force detection output signal of the sensor means is smaller than a preset value, the motor is driven in a direction to rotate the squeezee toward the window pane and, when the value of the pressing force detection output signal is larger than the preset value, the motor is driven in an opposite direction to rotate the squeezee away from the window pane whereby the squeezee is maintained at a constant pressing force against the window pane.

2. An automatic squeezee pressing device as defined in claim 1 wherein said connecting block comprises a tongue member to which the squeezee is pivotably connected and a box-like member connected to the tongue member and formed with slots therein and said moving shaft is connected to the box-like member by means of bolts inserted in slots of the box-like member.

3. An automatic squeezee pressing device as defined in claim 1 wherein the moving shaft is formed with a recess at the inner end thereof and the sensor means is provided in said recess in such a manner that transmission of power between the moving shaft and the connecting block is made through the sensor means.

* * * * *